US011300908B2

(12) United States Patent
Lee et al.

(10) Patent No.: US 11,300,908 B2
(45) Date of Patent: Apr. 12, 2022

(54) FIXING DEVICE COMPRISING NIP PLATE TREATED WITH ELECTRON BEAM INJECTED FLUORINATED RESINS

(71) Applicant: HEWLETT-PACKARD DEVELOPMENT COMPANY, L.P., Spring, TX (US)

(72) Inventors: Sunhyung Lee, Yongin-si (KR); Seachul Bae, Seoul (KR); Jaehyeok Jang, Seoul (KR); Jingue Ko, Yongin-si (KR); Yongho Chun, Daejeon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/284,392

(22) PCT Filed: Sep. 26, 2019

(86) PCT No.: PCT/US2019/053244
§ 371 (c)(1),
(2) Date: Apr. 9, 2021

(87) PCT Pub. No.: WO2020/096707
PCT Pub. Date: May 14, 2020

(65) Prior Publication Data

US 2021/0333734 A1 Oct. 28, 2021

(30) Foreign Application Priority Data

Nov. 7, 2018 (KR) ..... 10-2018-0136166

(51) Int. Cl.
*G03G 15/20* (2006.01)

(52) U.S. Cl.
CPC ..... *G03G 15/2057* (2013.01); *G03G 15/2064* (2013.01); *G03G 2215/2038* (2013.01)

(58) Field of Classification Search
USPC ..... 399/329
See application file for complete search history.

(56) References Cited

U.S. PATENT DOCUMENTS

| | | | | |
|---|---|---|---|---|
| 6,895,208 | B2 | 5/2005 | Nakatogawa et al. | |
| 8,559,861 | B2 | 10/2013 | Lee et al. | |
| 2004/0131401 | A1* | 7/2004 | Nakatogawa ..... | G03G 15/2053 399/328 |

FOREIGN PATENT DOCUMENTS

| | | | |
|---|---|---|---|
| CN | 100470400 | C | 3/2009 |
| CN | 104072971 | A | 10/2014 |
| JP | 3032726 | | 4/1997 |
| JP | 2004139004 | A | 5/2004 |
| JP | 6263848 | B2 | 9/2014 |
| KR | 20140056665 | | 5/2014 |

* cited by examiner

*Primary Examiner* — Quana Grainger
(74) *Attorney, Agent, or Firm* — Staas & Halsey LLP

(57) ABSTRACT

A fixing device includes a pressing member including a nip plate, and an electron beam-irradiated fluorinated resin film is to be on an outer surface of the nip plate facing toward the backup member.

16 Claims, 6 Drawing Sheets

FIXING DEVICE COMPRISING NIP PLATE TREATED WITH ELECTRON BEAM INJECTED FLUORINATED RESINS

CROSS REFERENCE TO RELATED APPLICATIONS

This application is filed under 35 U.S.C. 0.371 as a National Stage of PCT International Application No. PCT/US2019/053244, filed on Sep. 26, 2019, in the U.S. Patent and Trademark Office, which claims the priority benefit of Korean Patent Application No. 10-2018-0136166 filed in the Korean Intellectual Property Office on Nov. 7, 2018. The disclosures of PCT International Application No. PCT/US2019/053244 and Korean Patent Application No. 10-2018-0136166 are incorporated by reference herein in their entireties.

BACKGROUND

In electrophotographic imaging apparatuses such as facsimile machines, printers, copy machines, and the like, toner is supplied to an electrostatic latent image formed on an image receptor to form a visible toner image on the image receptor, the toner image is transferred onto a recording medium, and then the transferred toner image is fixed on the recording medium.

A fixing process includes a process of applying heat and pressure to toner. Generally, a fixing device includes a heating roller and a pressing roller that are engaged with each other to form a fixing nip. The heating roller is heated by a heater such as a halogen lamp or the like. The recording medium to which the toner image has been transferred is subjected to heat and pressure while passing through the fixing nip, and the toner image is fixed on the recording medium. For high-speed printing and low-energy fixing, a fixing belt having relatively low thermal capacity compared to a heating roller may be used.

DETAILED DESCRIPTION

Hereinafter, a fixing belt according to some examples of the present disclosure, and a fixing device and an electrophotographic imaging apparatus each employing the same will be described.

In a fixing method using a fixing belt, the fixing belt is located between a pressing member and a pressing roller that are arranged inside the fixing belt, and the pressing member and the pressing roller press against each other to thereby form a belt fixing nip. In this case, the fixing belt is rotated while being in contact with the pressing member, and thus the fixing belt is worn down, resulting in shortened lifespan and deteriorated fixing performance.

Therefore, there is a need for a fixing belt that may be efficiently used in high-speed printing and low-energy fixing methods during an extended period of time by minimizing abrasion of the fixing belt caused by friction between a pressing member and the fixing belt.

Figure 1:
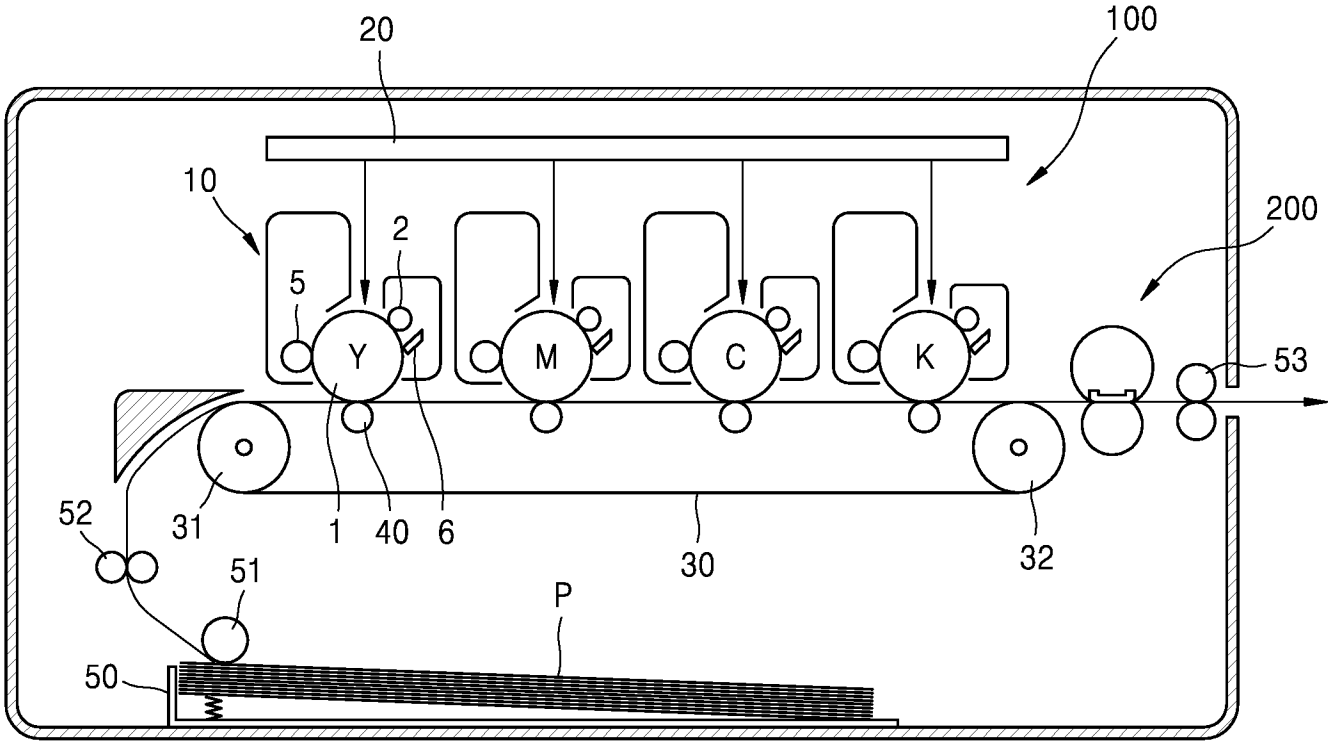
FIG. 1 is a schematic configuration view of an electrophotographic imaging apparatus according to an example of the present disclosure.

FIG. 1 is a schematic configuration view of an electrophotographic imaging apparatus according to an example of the present disclosure. Referring to FIG. 1, the electrophotographic imaging apparatus, for example, a printer may include: a printing unit 100 configured to form a visible toner image on a recording medium P, for example, paper; and a fixing device 200 configured to fix the toner image on the recording medium P. In the present example, the printing unit 100 forms a color toner image electrophotographically.

The printing unit 100 may include a plurality of photosensitive drums 1, a plurality of developing devices 10, and a paper transfer belt 30. The photosensitive drum 1 is an example of a photoconductor on which an electrostatic latent image is formed, and may include a conductive metal pipe and a photosensitive layer formed on an outer circumferential surface thereof. The developing devices 10 respectively correspond to the photosensitive drums 1, and each developing device 10 supplies toner to the electrostatic latent image formed on each photosensitive drum 1 and develops the latent image to form a toner image on a surface of each photosensitive drum 1. Each of the developing devices 10 may be replaced independently of the photosensitive drums 1. In addition, each developing device 10 may be in the form of a cartridge including the photosensitive drum 1.

For color printing, the developing devices 10 may include a plurality of developing devices 10Y, 10M, 10C, and 10K configured to receive toner of yellow (Y), magenta (M), cyan (C), and black (K) colors, respectively. The developing devices 10 may further include developing devices configured to receive toner of various colors such as light magenta, white, and the like in addition to the above-described colors. Hereinafter, an imaging apparatus including the developing devices 10Y, 10M, 10C, and 10K will be described. Unless otherwise specified, reference numerals with Y, M, C, or K respectively denote components for printing images by using toner of yellow (Y), magenta (M), cyan (C), and black (K) colors.

The developing device 10 supplies toner accommodated therein to an electrostatic latent image formed on the photosensitive drum 1 and develops the electrostatic latent image into a visible toner image. The developing device 10 may include a developing roller 5. The developing roller 5 supplies toner in the developing device 10 to the photosensitive drum 1. A developing bias voltage may be applied to the developing roller 5. A regulating member (not shown) restricts the amount of toner that is supplied by the developing roller 5 to a developing region where the photosensitive drum 1 and the developing roller 5 face each other.

In the case of a two-component developing method, magnetic carrier and toner may be accommodated in the developing device 10. The developing roller 5 may be spaced apart from the photosensitive drum 1 by tens to hundreds of microns. Although not illustrated in the drawing, the developing roller 5 may include a magnetic roller arranged in a hollow cylindrical sleeve. Toner is attached to a surface of the magnetic carrier. The magnetic carrier is attached to the surface of the developing roller 5 and transported to the developing region where the photosensitive drum 1 and the developing roller 5 face each other. Only the toner is supplied to the photosensitive drum 1 by the developing bias voltage applied between the developing roller 5 and the photosensitive drum 1, and thus the electrostatic latent image formed at the surface of the photosensitive drum 1 is developed into a visible toner image. The developing device 10 may include an agitator (not shown) that mixes and agitates toner with magnetic carrier and transport the resulting mixture to the developing roller 5. The agitator may be, for example, an auger, and the developing device 10 may be provided with a plurality of agitators.

In the case of a one-component developing method that does not use carrier, the developing roller 5 may be rotated while being in contact with the photosensitive drum 1. The developing roller 5 may also be rotated while being spaced apart from the photosensitive drum 1 by tens to hundreds of microns. The developing device 10 may further include a supply roller (not shown) configured to attach toner to the surface of the developing roller 5. A supply bias voltage may be applied to the supply roller. The developing device 10 may further include an agitator (not shown). The agitator may agitate toner to be frictionally charged. The agitator may be, for example, an auger.

A charging roller 2 is an example of a charger configured to charge the photosensitive drum 1 to have a uniform surface potential. A charging brush, a corona charger, or the like may be used instead of the charging roller 2.

A cleaning blade 6 is an example of a cleaning device configured to remove toner and impurities remaining on the surface of the photosensitive drum 1. Other forms of cleaning devices such as a rotary brush, and the like may also be used instead of the cleaning blade 6.

An example of a developing method of the electrophotographic imaging apparatus according to an example of the present disclosure will be described in detail. However, the present disclosure is not limited thereto, and various developing methods may be employed.

An exposer 20 emits light modulated to correspond to image information to photosensitive drums 1Y, 1M, 1C, and 1K to form electrostatic latent images corresponding to images of yellow (Y), magenta (M), cyan (C), and black (K) colors on the photosensitive drums 1Y, 1M, 1C, and 1K, respectively. As the exposer 20, a laser scanning unit (LSU) using a laser diode as a light source or a light emitting diode (LED) exposer using an LED as a light source may be used.

The paper transfer belt 30 supports and transfers the recording medium P. The paper transfer belt 30 may be supported by, for example, support rollers 31 and 32 and circulate. The recording medium P may be picked up one by one from a loading frame 50 by a pickup roller 51, transported by a transporting roller 52, and then attached to the paper transfer belt 30, for example, by an electrostatic force. A plurality of transfer rollers 40 may be arranged at positions facing the photosensitive drums 1Y, 1M, 1C, and 1K, with the paper transfer belt 30 arranged between the transfer rollers 40 and the photosensitive drums 1Y, 1M, 1C, and 1K. The transfer rollers 40 are an example of transfer devices that transfer the toner images from the photosensitive drums 1Y, 1M, 1C, and 1K to the recording medium P supported by the paper transfer belt 30. A transfer bias voltage is applied to the transfer rollers 40 to transfer the toner images to the recording medium P. A corona transfer unit or a pin scorotron-type transfer unit may be employed instead of the transfer roller 40.

The fixing device 200 may apply heat and/or pressure to the image transferred to the recording medium P to fix the transferred image to the recording medium P. The recording medium P having passed through the fixing device 200 is discharged by a discharge roller 53.

By the above configuration, the exposer 20 forms electrostatic latent images by irradiating the photosensitive drums 1Y, 1M, 1C, and 1K with a plurality of light beams modulated to correspond to image information of respective colors. The developing devices 10Y, 10M, 10C, and 10K form visible toner images of Y, M, C, and K colors at surfaces of the photosensitive drums 1Y, 1M, 1C, and 1K, respectively by respectively supplying toners of the Y, M, C, and K colors to the electrostatic latent images formed on the photosensitive drums 1Y, 1M, 1C, and 1K. The recording medium P loaded on the loading frame 50 is supplied to the paper transfer belt 30 by the pickup roller 51 and the transporting roller 52, and is held on the paper transfer belt 30, for example, by an electrostatic force. The toner images of Y, M, C, and K colors are sequentially transferred onto the recording medium P transported by the paper transfer belt 30, by the transfer bias voltage applied to the transfer rollers 40. When the recording medium P passes through the fixing device 200, the toner image is fixed on the recording medium P by heat and pressure. The recording medium P, on which the fixing process has been completed, is discharged by the discharge roller 53.

Although the imaging apparatus illustrated in FIG. 1 employs a method of directly transferring the toner images formed on the photosensitive drums 1Y, 1M, 1C, and 1K to the recording medium P supported by the paper transfer belt 30, other transferring methods may also be used. For example, a method of intermediately transferring the toner images developed on the photosensitive drums 1Y, 1M, 1C, and 1K to an intermedium transfer belt (not shown), and then transferring the transferred images to the recording medium P may also be employed.

In the case of printing a monochromic image, for example, an image of black color, the imaging apparatus may include only the developing device 10K among the developing devices 10Y, 10M, 10C, and 10K. The paper transfer belt 30 does not need to be provided. The recording medium P is transported between the photosensitive drum 1K and the transfer roller 40, and the toner image formed on the photosensitive drum 1K may be transferred to the recording medium P by the transfer bias voltage applied to the transfer roller 40.

The fixing device 200 applies heat and pressure to the toner image to fix the toner image on the recording medium P. To improve a printing speed and reduce energy consumption, a portion to be heated of the fixing device 200 may have a smaller thermal capacity. For example, the fixing device 200 including a thin film-type endless belt as the portion to be heated may be employed. Thus, the temperature of the fixing device 200 may be rapidly increased up to a fixable temperature, and a state in which image formation is possible after the imaging apparatus is powered on may be reached within a short period of time.

Figure 2:
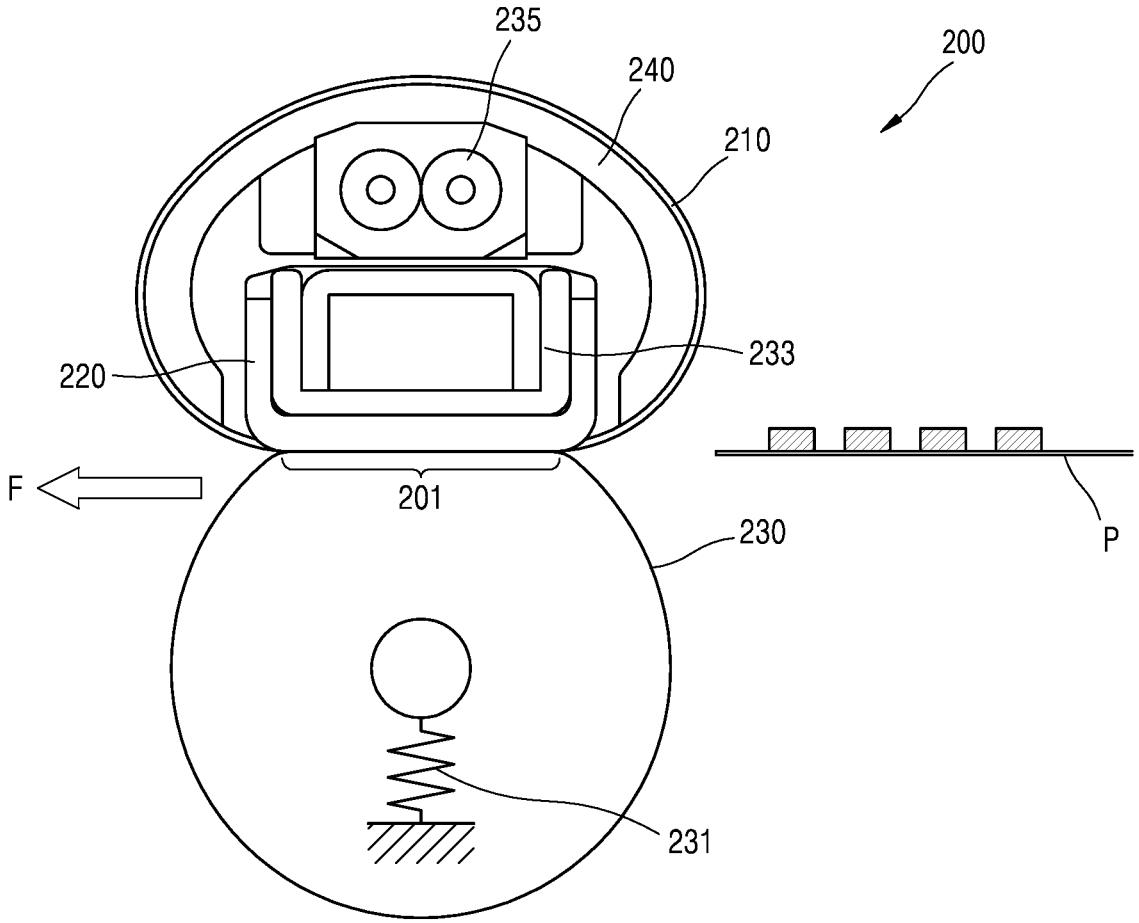
FIG. 2 is a cross-sectional view of a fixing device according to an example of the present disclosure, which may be installed in the electrophotographic imaging apparatus of FIG. 1.

FIG. 2 is a cross-sectional view of the fixing device 200 according to an example of the present disclosure that may be installed in the electrophotographic imaging apparatus of FIG. 1.

Referring to FIG. 2, the fixing device 200 includes a fixing belt 210 that is rotatable and has an endless belt form, a backup member 230 provided outside the fixing belt 210 and in contact with the fixing belt 210, and configured to drive the fixing belt 210 in a direction F indicated by an arrow, a heat source 235 (e.g., a halogen lamp) provided in the fixing belt 210, a metal bracket 233 provided below the heat source 235 and configured to support the heat source 235, and a pressing member 220 provided between the metal bracket 233 and the fixing belt 210, and configured to transmit heat and pressure from the heat source 235 and the metal bracket 233 to the fixing belt 210 and form a fixing nip 201 while facing the backup member 230. Although not illustrated in FIG. 2, an electron beam-irradiated fluorinated resin film is attached to a lower portion of the pressing member 220. For example, an electron beam-irradiated fluorinated resin film 222 (see FIG. 4) is attached to an outer surface of a nip plate 220*b* (see FIG. 3) towards the backup member 230.

The backup member 230 may be, for example, a backup roller, i.e., a pressing roller, and may be arranged to be in contact with the pressing member 220 with the fixing belt 210 therebetween, such that the backup member 230 and the pressing member 220 rotate while pressing against each other, thereby driving the fixing belt 210.

Figure 3:
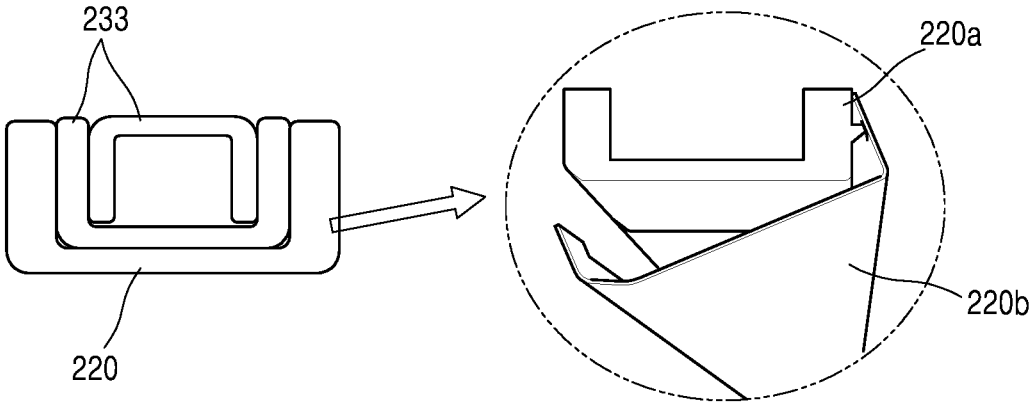
FIG. 3 is a detailed cross-sectional view of a pressing member and a metal bracket that are illustrated in FIG. 2.

FIG. 3 is a detailed cross-sectional view of the pressing member 220 and the metal bracket 233 that are illustrated in FIG. 2.

Referring to FIG. 3, the pressing member 220 includes an inner holder 220*a* configured to support the metal bracket 233 and the nip plate 220*b* attached to an outer surface of the inner holder 220*a*. The nip plate 220*b* may include a metal selected from stainless steel, nickel, and aluminum. In particular, the nip plate 220*b* may be a plate made of a metal selected from stainless steel, nickel, and aluminum. The inner holder 220*a* may be, for example, a structure in which a heat-resistant organic polymer is molded into a predetermined shape or form. As illustrated in FIG. 3, the inner holder 220*a* may include, for example, first and second side wall portions that are separated from each other, and a base portion that connects the first side wall portion to the second side wall portion.

Figure 4:
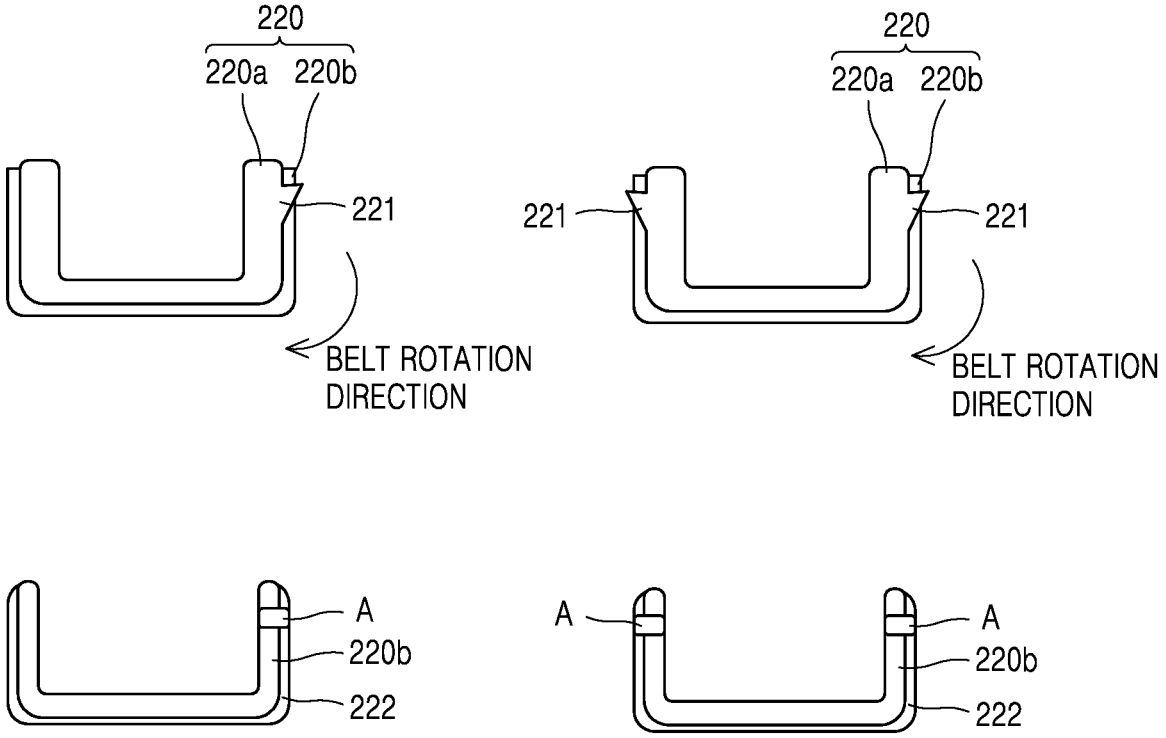
FIG. 4 is a cross-sectional view illustrating a state in which an electron beam-irradiated fluorinated resin film is attached to a pressing member, according to an example of the present disclosure.

FIG. 4 is a cross-sectional view illustrating a state in which the electron beam-irradiated fluorinated resin film 222 is attached to the pressing member 220, according to examples of the present disclosure.

Referring to FIG. 4, a convex portion 221 protrudes from an outer surface of at least one of the first and second side wall portions of the inner holder 220*a*. A concave portion is formed at an inner surface of the nip plate 220*b* to correspond to the convex portion 221, and the convex portion 221 may be inserted into the concave portion such that the nip plate 220*b* is coupled to the inner holder 220*a*.

According to another example, the convex portion 221 protrudes from an outer surface of at least one of the first and second side wall portions of the inner holder 220*a*, and an opening A passing through the nip plate 220*b* and the fluorinated resin film 222 is formed. The convex portion 221 may be inserted into the opening A such that the nip plate 220*b* is coupled to the inner holder 220*a*, and the fluorinated resin film 222 is attached to the outer surface of the nip plate 220*b*.

Referring back to FIG. 2, the heat source 235 such as a halogen lamp is provided inside the fixing belt 210. The backup member 230 is provided outside the fixing belt 210 such that the backup member 230 faces the pressing member 220. The pressing member 220 and the backup member 230 press against each other with the fixing belt 210 disposed therebetween. For example, a temperature sensor (not shown) and a thermostat (not shown) may be installed at an upper portion of the heat source 235. In addition, a pressing force acting towards the metal bracket 233 and the backup member 230 may be applied by a pressing member (not shown), e.g., a spring device, to the upper portion of the heat source 235, perpendicularly to a direction in which the fixing belt 210 circulates.

As illustrated in FIG. 2, a pressing force acting towards the pressing member 220 may also be applied to the backup member 230 by a pressing member, for example, a spring 231. The backup member 230 may drive the fixing belt 210. For example, the backup member 230 may be a backup roller or a pressing roller configured such that an elastic layer is formed on an outer circumferential surface of a metallic core. The backup member 230 may rotate while pressing against the pressing member 220 with the fixing belt 210 disposed therebetween, thereby driving the fixing belt 210. The pressing member 220 forms the fixing nip 201 along with the backup member 230, and guides the fixing belt 210 to be driven. A belt guide 240 may be further provided at an outer side of the fixing nip 201 so that the fixing belt 210 can be smoothly driven. The belt guide 240 may be integrally formed with the pressing member 220, and may be a separate member from the pressing member 220.

Referring back to a lower side of FIG. 4, as described above, FIG. 4 is a cross-sectional view illustrating examples of the pressing member 220 illustrated in FIG. 2. Referring to FIG. 4, the electron beam-irradiated fluorinated resin film 222 is attached to a lower portion of the pressing member 220. For example, the electron beam-irradiated fluorinated resin film 222 is attached to an outer surface of the nip plate 220*b*, towards the backup member 230.

The electron beam-irradiated fluorinated resin film 222 may include at least one fluorinated resin selected from the group consisting of a copolymer of tetrafluoroethylene and perfluoroether, which is also referred to as perfluoroalkoxy (PFA); polytetrafluoroethylene (PTFE); and a copolymer of tetrafluoroethylene and hexafluoropropylene, which is also referred to as fluorinated ethylene propylene (FEP). For example, the fluorinated resin film 222 may be a film formed of at least one fluorinated resin selected from the group consisting of a copolymer of tetrafluoroethylene and perfluoroether (PFA), polytetrafluoroethylene (PTFE), and a copolymer of tetrafluoroethylene and hexafluoropropylene (FEP).

Figure 5:
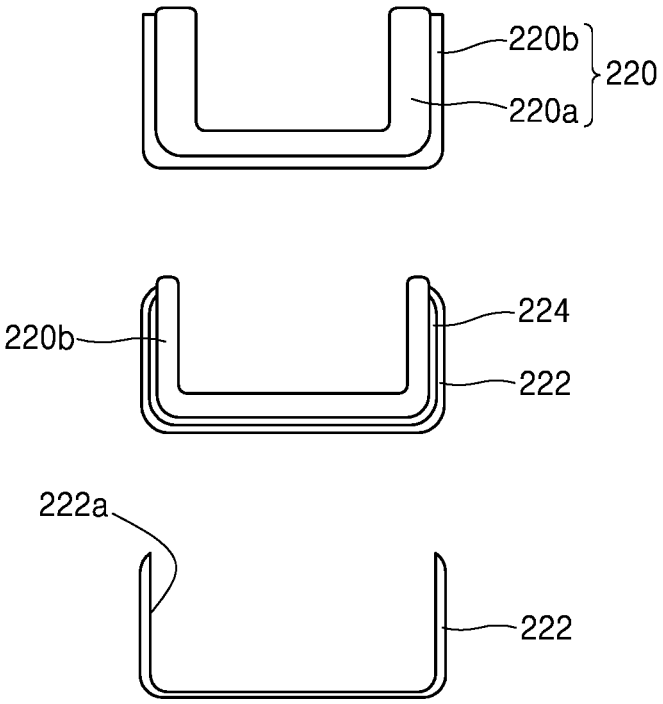
FIG. 5 is a cross-sectional view illustrating another state in which an electron beam-irradiated fluorinated resin film is attached to a pressing member, according to an example of the present disclosure.

FIG. 5 is a cross-sectional view illustrating another state in which the electron beam-irradiated fluorinated resin film 222 is attached to the pressing member 220, according to an example of the present disclosure.

Referring to FIG. 5, a primer layer 224 is first formed on an outer surface of the nip plate 220*b* to facilitate attachment of the electron beam-irradiated fluorinated resin film 222 to the nip plate 220*b*. Thus, the primer layer 224 is provided between the nip plate 220*b* and the electron beam-irradiated fluorinated resin film 222 to facilitate the attachment of the fluorinated resin film 222 to the nip plate 220*b*. When the primer layer 224 is used, there is no need to couple the fluorinated resin film 222 to the inner holder 220*a* by forming the opening A in the fluorinated resin film 222 and inserting the convex portion 221 of the inner holder 220*a* into the opening A or to perform oxidation treatment, which will be described below. On the other hand, when the fluorinated resin film 222 is coupled to the inner holder 220*a* by forming the opening A in the fluorinated resin film 222 and inserting the convex portion 221 of the inner holder 220*a* into the opening A, there is no need to form the primer layer 224.

Meanwhile, a surface 222*a* of the fluorinated resin film 222 which faces the nip plate 220*b* may be oxidized. An adhesion between the oxidized surface 222*a* of the fluorinated resin film 222 and the primer layer 224 may be increased. That is, a water contact angle at the oxidized surface 222*a* of the fluorinated resin film 222 may be less than or equal to that at a non-oxidized surface of the fluorinated resin film 222. The oxidation process may be performed by oxygen plasma treatment or ammonia plasma treatment. When the fluorinated resin film 222 is subjected to oxygen plasma treatment, a fluorinated resin is oxidized, and thus a reactive group such as a carboxylic group, or the like may be formed at the surface 222*a*, and thus the surface 222*a* may have an increased adhesion. The fluorinated resin film 222 may have a thickness of about 10 μm to about 200 μm, for example, about 20 μm to about 180 μm, about 40 μm to about 160 μm, about 60 μm to about 140 μm, about 80 μm to about 120 μm, about 90 μm to about 110 μm, or about 110 μm.

Fluorinated resins have a low coefficient of friction, high weather resistance, and high thermal stability, as compared to those of non-fluorinated resins. Fluorinated resins may be relatively chemically stable, inert, and less reactive. A general fluorinated resin has a linear molecular structure, but when a fluorinated resin film is irradiated with electron beams in a vacuum, a carbon-carbon (C—C) bond in a main chain or a carbon-fluorine (C—F) covalent bond in a side chain of the fluorinated resin may be cleaved. Subsequently, the cleaved portions may be recombined to form a new covalent bond, and consequently, crosslinking may be formed between linear molecules. In addition to the formation of crosslinking, branches containing a trifluoromethyl ($CF_3$) group may be formed. As a result of the formation of crosslinking, the molecular weight of a fluorinated resin increases exponentially, as compared to that of the fluorinated resin before irradiation of electron beams. The molecular weight of the fluorinated resin becomes larger due to such crosslinking, and thus the fluorinated resin has very high mechanical strength. When a fluorinated resin film is irradiated with electron beams at a high temperature, crosslinking density may be increased relative to when a fluorinated resin film is irradiated with electron beams at room temperature.

Thus, when the electron beams-irradiated fluorinated resin film 222 is attached to the outer surface of the nip plate 220*b* towards the backup member 230, sliding properties of the fixing belt 210 may be enhanced, and the wearing of the fixing belt 210 and the nip plate 220*b*, which is caused by friction between the fixing belt 210 and the nip plate 220*b*, may be minimized.

In a general belt-type fixing device, a surface of the nip plate 220*b* of the pressing member 220, which is in contact with the fixing belt 210, is coated with grease, thereby minimizing friction occurring during rotation of the fixing belt 210. Due to the friction, abrasion marks such as scratches may be formed on the surfaces of the fixing belt 210 and the nip plate 220*b*. Fine particles formed by such abrasion may deteriorate performance of the grease and increase a driving torque of the fixing device. In the present example, however, a surface of the fluorinated resin film 222 is coated with grease, and the wearing of the fixing belt 210 and the nip plate 220*b*, which occurs by friction between the fixing belt 210 and the nip plate 220*b*, may be minimized due to a low coefficient of friction and a high strength of the fluorinated resin film 222. Accordingly, abrasion cracks such as scratches and cracks that may occur at the surfaces of the fixing belt 210 and the nip plate 220*b* due to friction between the nip plate 220*b* of the pressing member 220 and a blackened layer 214 (see FIG. 6) inside the fixing belt 210 and the generation of fine particles and damage to the fixing belt 210, which occur by such abrasion, may be minimized. Thus, in the fixing device according to the present example, deterioration of the performance of grease and an increase in driving torque of the fixing device, which occur due to abrasion, may be minimized, and the fixing device may have an increased lifespan. In addition, when the blackened layer 214 of the fixing belt 210 is worn down, a difference in radiation heating amount between a worn portion and a non-worn portion occurs, and thus a temperature difference occurs at the surface of the fixing belt 210, thus causing the occurrence of a gloss difference on a fixed image.

Figure 6:
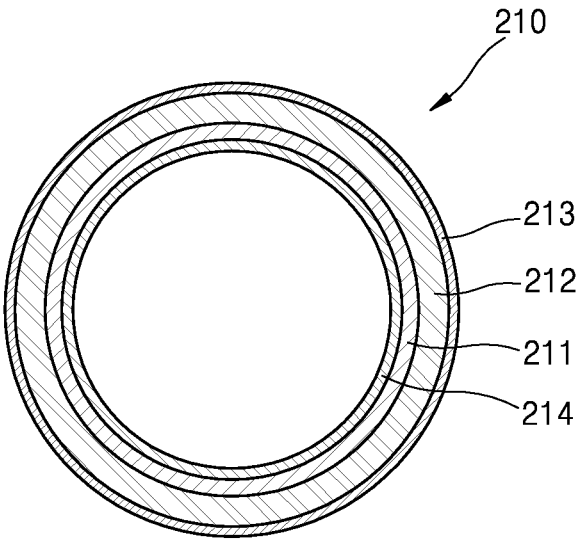
FIG. 6 is a cross-sectional view of a fixing belt that is rotatable and has an endless belt form, according to an example of the present disclosure.

FIG. 6 is a cross-sectional view of the fixing belt 210 that is rotatable and has an endless belt shape, according to an example of the present disclosure.

Referring to FIG. 6, the fixing belt 210 may include a substrate layer 211 that is rotatable and has an endless belt shape. The substrate layer 211 may include at least one metal selected from stainless steel, nickel, and aluminum. For example, the substrate layer 211 may be a film layer formed of at least one metal selected from stainless steel, nickel, and aluminum. In another example, the substrate layer 211 may be a film layer formed of at least one resin having excellent heat resistance and excellent abrasion resistance selected from a polyimide (PI), a polyamide (PA), and a polyamide-imide (PAI). In another example, the substrate layer 211 may have a structure including: a first base resin; and a first thermally conductive filler dispersed in the first base resin. The first base resin may be at least one of the above-described resins having excellent heat resistance and excellent abrasion resistance. The first base resin may be one of the above-described polymers or a blend of two or more of these polymers. These polymers may have heat resistance that enables these polymers to endure a fixing temperature of, for example, about 120° C. to about 200° C. and abrasion resistance. The first thermally conductive filler may be at least one selected from carbon black, graphite, boron nitride (BN), carbon nanotubes (CNTs), and carbon fibers. The first thermally conductive filler may have a particle shape or a fibrous shape, and may have a large aspect ratio to increase thermal conductivity. For example, the first thermally conductive filler may include carbon fiber having an average length of about 6 μm or more in an amount of about 30 parts by weight to about 50 parts by weight with respect to 100 parts by weight of the first base resin. To improve bending resistance of the substrate layer 211, the amount of the first thermally conductive filler may be adjusted to about 40 parts by weight or less. The first thermally conductive filler may include carbon fiber having an average length of about 7 μm or more in an amount of about 30 parts by weight to about 50 parts by weight based on 100 parts by weight of the first base resin. The first thermally conductive filler may include carbon fiber having an average length of about 8 μm or more in an amount of about 30 parts by weight to about 50 parts by weight based on 100 parts by weight of the first base resin. An upper limit of the average length of the carbon fiber is not particularly limited, but may vary depending on commercial availability. The upper limit of the average length of the carbon fiber may be, for example, about 100 μm or less, for example, about 50 μm or less, about 40 μm or less, about 30 μm or less, about 20 μm or less, about 15 μm or less, about 14 μm or less, about 13 μm or less, about 12 μm or less, about 11 μm or less, or about 10 μm or less. By adjusting the amount and average length of the first thermally conductive filler within the above-described ranges, the substrate layer 211 may have a thermal conductivity in a thickness direction of about 1.5 W/m·K or more, for example, about 1.8 W/m·K or more. The carbon fibers may be, for example, vapor grown carbon fibers (VGCFs).

The thickness of the substrate layer 211 may be selected to have flexibility and elasticity sufficient to enable the fixing belt 210 to be flexibly deformed in the fixing nip 201 and to be restored to its original state after escaping from the fixing nip 201. For example, the substrate layer 211 may have a thickness of about 30 μm to about 200 μm, for example, about 75 μm to about 100 μm or about 50 μm to about 100 μm.

When the first base resin of the substrate layer 211 is a polyimide, the substrate layer 211 may be formed using, for example, the following method. First, a dianhydride compound and a diamine compound are allowed to react to obtain a polyamic acid. Non-limiting examples of suitable dianhydride compounds include pyromellitic dianhydride (PMDA), 3,3',4,4'-biphenyltetracarboxylic dianhydride, 4,4'-hexafluoroisopropylidene bis(phthalic anhydride), 4,4',5,5'-sulfonyldiphthalic anhydride, 3,3',4,4'-benzophenonetetracarboxylic dianhydride, and 3,3',4,4'-oxydiphthalic anhydride. Non-limiting examples of suitable diamine compounds include p-phenylene diamine (p-PDA), m-phenylene diamine, 4,4'-oxydianiline (ODA), 4,4'-methylene diamine, and 4,4'-diaminophenyl sulfone. The polyamic acid may be obtained by reaction between the dianhydride compound and the diamine compound in a stoichiometric ratio of about 0.9 to 1:about 0.9 to 1 at a relatively low temperature, for example, at room temperature. The reaction may be carried out in dipolar aprotic amide solvents such as dimethyl acetamide (DMAc) and N-methyl-2-pyrrolidone (NMP). Next, a first thermally conductive filler such as carbon fiber is dispersed in the polyamic acid by roll milling to obtain a dispersion. The quantitative relationship between both materials may be adjusted within the above-described ranges. Examples of a dispersion method include, but are not limited to, rotation milling in which milling is performed by placing a target to be dispersed in a container along with milling beads and rotating the target using a dispersion rotor, and roll milling, e.g., three-roll milling in which a target to be dispersed is milled using three rolls, i.e., a feed roll, a center roll, and an apron roll, that rotate while being engaged with one another. When the rotation milling method is used, a rotational force applied to the milling beads is too strong, so that the length of the first thermally conductive filler may be shortened. In this case, it may adversely affect the formation of a thermally conductive path or a thermally conductive network in the substrate layer 211. In this case, it may be disadvantageous to increase the thermal conductivity of the substrate layer 211. When the three-roll milling method is used, a physical force applied to the first thermally conductive filler may be minimized, thereby minimizing the shortening of the length thereof, and thus the thermal conductivity of the substrate layer 211 may be enhanced.

Subsequently, the resulting dispersion may be formed into a film, and then the film may be heated at a temperature ranging from about 300° C. to about 380° C., for example, about 320° C. to about 370° C., about 330° C. to about 360° C., about 340° C. to about 355° C., or about 340° C. to about 350° C. to cause imidization, thereby obtaining the substrate layer 211 formed of a polyimide.

When the substrate layer 211 formed of a polyimide and including the first thermally conductive filler is used, excellent bending resistance and excellent crack resistance may be obtained, and thus the lifespan of the fixing belt 210 may be increased, and a thermally conductive path or network may also be efficiently formed by the first thermally conductive fillers, thus achieving high thermal conductivity.

In a fixing belt-type fixing method using a halogen lamp as a heat source, a film layer formed of at least one metal selected from stainless steel, nickel, and aluminum is generally used as the substrate layer 211.

The outermost layer of the fixing belt 210 may be a release layer 213. In a fixing process, toner on the recording medium P is melted, and thus an offset phenomenon, in which the toner is attached to the fixing belt 210, may occur. The offset phenomenon may cause a printing failure such that a portion of a printed image on the recording medium P is missed, and cause a jam in which the recording medium P that has escaped from the fixing nip 201 is not separated from the fixing belt 210 and is attached to an outer surface of the fixing belt 210. The release layer 213 may be a heat-resistant resin layer having excellent separability to prevent the offset phenomenon. The release layer 213 may include, for example, at least one fluorine resin selected from the group consisting of a copolymer of tetrafluoroethylene and perfluoroether, which is also referred to as perfluoroalkoxy (PFA); polytetrafluoroethylene (PTFE); and a copolymer of tetrafluoroethylene and hexafluoropropylene, which is also referred to as fluorinated ethylene propylene (FEP). These fluorine resins may be used alone or a blend of two or more of these fluorine resins may be used. The release layer 213 may be formed by covering the substrate layer 211 by a tube made of the above-described material or coating the surface of the substrate layer 211 with the above-described material. The release layer 213 may have a thickness of, for example, about 10 μm to about 30 μm or about 20 μm to about 30 μm. For example, the release layer 213 may be formed by coating the substrate layer 211 or an elastic layer 212 with an adhesive or a primer and attaching a fluorinated resin tube having a thickness of about 20 μm to about 30 μm to the resulting structure.

As illustrated in FIG. 6, the fixing belt 210 according to an example of the present disclosure may further include the elastic layer 212 between the substrate layer 211 and the release layer 213. The elastic layer 212 facilitates formation of the fixing nip 201 that is relatively wide and smooth. When a fixing belt including the elastic layer 212 is used, the image quality of a printed material may be enhanced. Thus, the fixing belt 210 including the elastic layer 212 is often used in imaging apparatuses for color image formation. The elastic layer 212 may be formed of a heat-resistant material that is able to endure a fixing temperature. For example, in an example, the elastic layer 212 may include at least one elastic resin selected from the group consisting of a fluorine-containing rubber, a silicone rubber, natural rubber, an isoprene rubber, a butadiene rubber, a nitrile rubber, a chloroprene rubber, a butyl rubber, an acrylic rubber, a hydrin rubber, an urethane rubber, a polystyrene-based resin, a polyolefin resin, a polyvinyl chloride-based resin, a polyurethane resin, a polyester resin, a polyamide resin, a polybutadiene-based resin, a trans-polyisoprene-based resin, and a chlorinated polyethylene-based resin. For example, the elastic layer 212 may be a film layer formed of at least one of the above-described elastic resins. In another example, the elastic layer 212 may include a second base resin and a second thermally conductive filler dispersed in the second base resin. The second base resin may include at least one of the above-described elastic resins. The elastic resin may be an elastic rubber or a thermoplastic elastomer having thermal resistance that is able to endure a fixing temperature of, for example, about 120° C. to about 200° C. and abrasion resistance. The second base resin may be any one of the above-listed elastic resins, or a blend of two or more of these elastic resins.

The elastic layer 212 may include a second thermally conductive filler dispersed in the second base resin. The second thermally conductive filler may be at least one selected from silicon carbide (SiC), silicon nitride ($Si_3N_4$), boron nitride (BN), aluminum nitride (AlN), alumina ($Al_2O_3$), zinc oxide (ZnO), magnesium oxide (MgO), silica ($SiO_2$), copper (Cu), aluminum (Al), silver (Ag), iron (Fe), nickel (Ni), carbon black, graphite, carbon nanotubes (CNTs), and carbon fibers. The second thermally conductive filler may have a particle shape or a fibrous shape, and may have a large aspect ratio to increase thermal conductivity. For example, in terms of bending resistance and thermal conductivity, the second thermally conductive filler may include about 60 parts by weight to about 70 parts by weight of SiC, about 0 parts by weight to about 10 parts by weight of BN, and about 0.5 parts by weight to about 5 parts by weight, for example, about 2 parts by weight to about 4 parts by weight or about 2 parts by weight to about 3 parts by weight of carbon fibers having an average length of about 6 μm or more, with respect to 100 parts by weight of the second base resin. The second thermally conductive filler may include carbon fiber having an average length of about 7 μm or more in an amount of about 0.5 parts by weight to about 5 parts by weight, for example, about 2 parts by weight to about 4 parts by weight or about 2 parts by weight to about 3 parts by weight, with respect to 100 parts by weight of the second base resin. To increase the thermal conductivity of the elastic layer 212, a large amount of the second thermally conductive filler needs to be mixed. However, when the amount of the second thermally conductive filler is increased, adhesion between the substrate layer 211 and the elastic layer 212 and adhesion between the elastic layer 212 and the release layer 213 may be reduced, or the binding strength of the elastic layer 212 itself becomes weaker, thus reducing the lifespan of the fixing belt 210.

For example, the second thermally conductive filler may include carbon fibers having an average length of about 8 μm or more in an amount of about 0.5 parts by weight to about 5 parts by weight, for example, about 2 parts by weight to about 4 parts by weight or about 2 parts by weight to about 3 parts by weight, with respect to 100 parts by weight of the second base resin. Although not particularly limited, an upper limit of the average length of the carbon fibers may be restricted in accordance with commercial availability. The upper limit of the average length of the carbon fibers may be, for example, about 100 μm or less, for example, about 50 μm or less, about 40 μm or less, about 30 μm or less, about 20 μm or less, about 15 μm or less, about 14 μm or less, about 13 μm or less, about 12 μm or less, about 11 μm or less, or about 10 μm or less. By adjusting the amount and average length of the second thermally conductive filler within the above-described ranges, the elastic layer 212 may have a thermal conductivity in a thickness direction of about 1.3 W/m·K or more, for example, about 1.4 W/m·K or more, about 1.5 W/m·K or more, or about 1.6 W/m·K or more. The carbon fibers may be, for example, vapor grown carbon fibers (VGCFs).

The thickness of the elastic layer 212 may be selected to have flexibility and elasticity sufficient to enable the fixing belt 210 to be flexibly deformed in the fixing nip 201 and to be restored to its original state after escaping from the fixing nip 201. For example, the thickness of the elastic layer 212 may range from, for example, about 10 μm to about 300 μm, for example, about 50 μm to about 250 μm, about 70 μm to about 200 μm, about 60 μm to about 150 μm, about 70 μm to about 130 μm, or about 80 μm to about 120 μm in consideration of heat transfer to the recording medium P. By adjusting the amount and average length of the second thermally conductive filler within the above-described ranges, the elastic layer 212 may have a thermal conductivity in a thickness direction of about 1.3 W/m·K or more. The carbon fibers may be, for example, vapor grown carbon fibers (VGCFs).

In an example, in a case in which the heat source 235 provided inside the fixing belt 210 emits radiation rays like a halogen lamp to heat the fixing belt 210, the blackened layer 214 is provided on an inner surface of the substrate layer 211 that is in contact with the fluorinated resin film 222 to efficiently heat the fixing belt 210. The blackened layer 214 may be a metal oxide layer that may be heated by radiation rays from the heat source 235. The metal oxide may be an iron oxide, for example, ferric oxide ($Fe_2O_3$). The thickness of the blackened layer 214 may range from about 1 μm to about 10 μm, for example, about 2 μm to about 8 μm, for example, about 2 μm to about 5 μm so that the fixing belt 210 is sufficiently radiated and heated by the heat source 235, and thus heat needed for image fixation can be sufficiently transmitted to the recording medium P.

As described above, in the fixing device 200 of the present disclosure, since, to enhance slidability of the fixing belt 210, the fluorinated resin film 222 having a low coefficient of friction and a high strength is attached to a surface of the pressing member 220, particularly the nip plate **220*b* which is in contact with the fixing belt 210, wearing of the fixing belt 210 and the nip plate 220*b*, which occurs due to friction between the fixing belt 210 and the nip plate 220*b*, may be minimized. Thus, damage to the fixing belt 210, such as abrasion that may occur at surfaces of the fixing belt 210 and the nip plate 220*b*, which is caused by friction between the nip plate 220*b* of the pressing member 220 and the blackened layer 214 inside the fixing belt 210, and the generation of fine particles, cracks, and the like that are caused by such abrasion, may be minimized. Accordingly, in the fixing device 200 of the present disclosure, deterioration of the performance of grease due to abrasion and an increase in driving torque of the fixing device 200 may be minimized, and the lifespan of the fixing device 200 may be increased. In addition, in the fixing device 200 of the present disclosure, image defects that occur due to a temperature difference caused by abrasion of the blackened layer 214 may be efficiently prevented, thereby achieving a high-performance fixing device. When the blackened layer 214 of the fixing belt 210 is worn down, a difference in a radiation heating amount between a worn portion and a non-worn portion occurs, and thus a temperature difference occurs at the surface of the fixing belt 210**, thus causing a difference in gloss on a fixed image.

By minimizing the abrasion of a fixing belt due to friction between a pressing member and a fixing belt, a fixing device according to the present disclosure may be efficiently used in high-speed printing and low-energy fixing methods for an extended period of time.

Hereinafter, the present disclosure will be described in further detail with reference to the following comparative examples and examples. However, these examples are provided for illustrative purposes and are not intended to limit the scope of the present disclosure.

Comparative Example 1

The pressing member 220, which consisted of the inner holder 220*a* fabricated through injection molding of a liquid crystal polymer (LCP) resin having a shape illustrated in FIG. 3 and having a length of 240 mm and a width of 22 mm, and the nip plate 220*b* covering the inner holder 220*a*, made of stainless steel (SUS), and having a thickness of 0.2 mm, was prepared.

A 60% aqueous dispersion (Manufacturer: Dupont, Product Name: DuPont™ Teflon® PFA TE-7224) of a copolymer of tetrafluoroethylene and perfluoroether (PFA) was prepared. The PFA dispersion was spray-coated onto a surface of the nip plate 220*b* and cured at a temperature ranging from about 250° C. to 350° C. In this manner, a PFA coating having a thickness of about 20 μm was formed on the surface of the nip plate 220*b*.

Comparative Example 2

The pressing member 220 as described in Comparative Example 1, which consisted of the inner holder 220*a* and the nip plate 220*b* covering the inner holder 220*a* and made of stainless steel (SUS), was prepared.

A mixed coating solution (manufactured by Daikin Industries Ltd., TCL-7109-611 (7109BK)) of PFA and a polyamideimide resin (PAI) was prepared. The coating solution is a mixed coating solution of PFA+PAI having a solid content of about 50 wt %, and was obtained by dissolving a mixed resin prepared by mixing PFA and PAI in a weight ratio of PFA to PAI of about 1:1 to 3 in an NMP solvent. The mixed coating solution of PFA and PAI was spray-coated onto a surface of the nip plate 220*b* and cured at about 200° C. In this manner, a coating formed of a blend of PFA and PAI and having a thickness of about 30 μm was formed on the surface of the nip plate 220*b*.

Comparative Example 3

The pressing member 220 as described in Comparative Example 1, which consisted of the inner holder 220*a* and the nip plate 220*b* covering the inner holder 220*a* and made of stainless steel (SUS), was prepared.

A coating solution, in which polytetrafluoroethylene (PTFE) resin and polyphenylene sulfide (PPS) particles having a mean particle diameter of about 1 μm were dispersed in water in a weight ratio of PTFE resin to PPS particles of about 80:20, was prepared. The PTFE resin coating solution was spray-coated onto a surface of the nip plate 220*b* and cured at a temperature of about 200° C. to about 300° C. Consequently, a coating formed of PPS+PTFE resin and having a thickness of about 30 μm was formed on the surface of the nip plate 220*b*.

Comparative Example 4

The pressing member 220 as described in Comparative Example 1, which consisted of the inner holder 220*a* and the nip plate 220*b* covering the inner holder 220*a* and made of stainless steel (SUS), was prepared.

An about 60 wt % PFA coating solution (manufactured by Dupont), in which a copolymer of tetrafluoroethylene and perfluoroether (PFA), which was irradiated with electron beams, was dispersed in water, was prepared. The PFA coating solution was spray-coated onto a surface of the nip plate 220*b* and cured at a temperature ranging from about 250° C. to about 350° C. Consequently, a coating formed of the electron beam-irradiated PFA and having a thickness of about 20 μm was formed on the surface of the nip plate 220*b*.

Example 1

The pressing member 220 as described in Comparative Example 1, which consisted of the inner holder 220*a* and the nip plate 220*b* covering the inner holder 220*a* and made of stainless steel (SUS), was prepared.

A film (manufacturer: Sumitomo Chemical Company) irradiated with electron beams, having a thickness of about 100 μm, and formed of a copolymer of tetrafluoroethylene and perfluoroether (PFA) was attached to a surface of the nip plate 220*b* using a heat-resistant adhesive.

Figure 7:
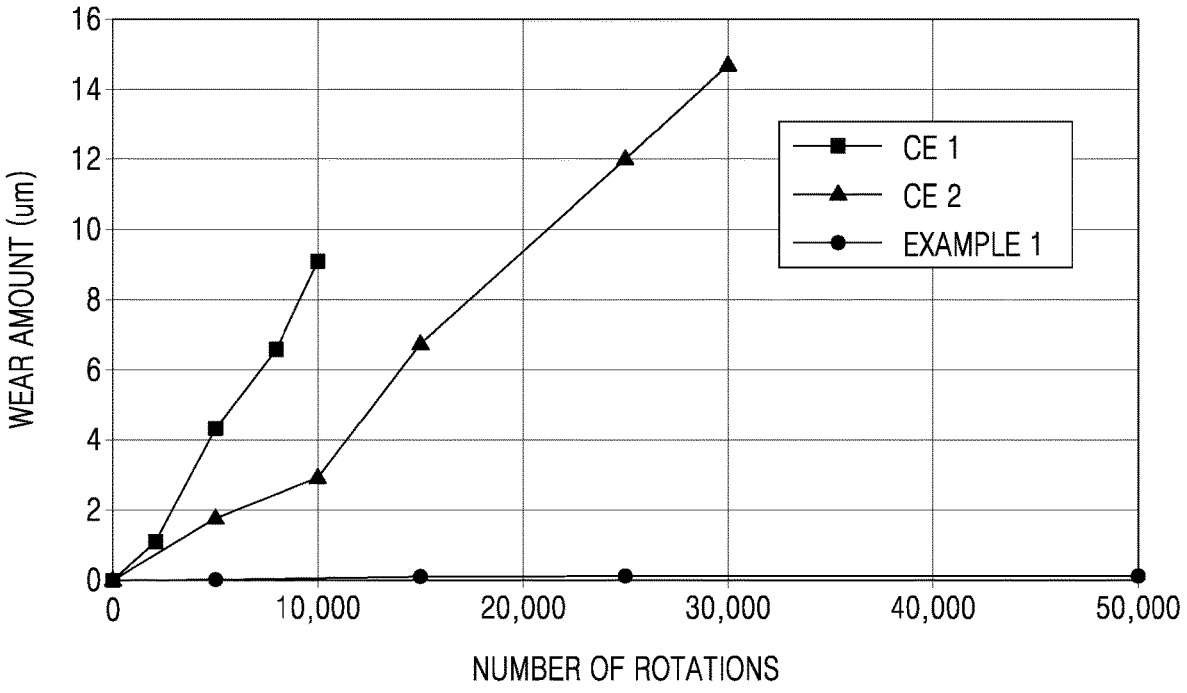
FIG. 7 is a graph showing results of evaluating abrasion resistance of nip plates manufactured according to Comparative Examples 1 and 2 (denoted as CE 1 and CE 2, respectively) and Example 1.

FIG. 7 is a graph showing results of evaluating abrasion resistance of the nip plates 220*b* manufactured according to Comparative Examples 1 and 2 and Example 1. The abrasion resistance evaluation was performed using the following method: Each of nip plate specimens to which a coating layer or a coating film was attached was fixed. A #3000 sandpaper was placed on the coating layer or coating film of each specimen and a load of 2 kg was applied thereto. A rotation speed of the sandpaper was about 200 rpm and a wear amount of each specimen was measured over time. In FIG. 7, for example, a number of rotations of 10,000 indicates that the abrasion resistance test was performed at a rotation speed of about 200 rpm for 50 minutes.

Referring to the results of FIG. 7, the wearing of the PFA coating of Comparative Example 1 (CE 1) was rapidly increased over time. It was confirmed that the coating of a blend of PAI and PFA of Comparative Example 2 (CE 2) exhibited a smaller wear amount than that of the PFA coating of Comparative Example 1, but also exhibited an increased wear amount over time. In contrast, the electron beam-irradiated PFA film of Example 1 hardly worn over time even when the number of rotations was increased. Thus, it was confirmed that the electron beam-irradiated PFA film had improved abrasion resistance as compared to other materials. Accordingly, by attaching the electron beam-irradiated fluorinated resin film to the nip plate 220*b*, issues related to the wearing of the nip plate 220*b* may be addressed. In addition, the electron beam-irradiated fluorinated resin film has a much lower coefficient of friction than that of the blackened layer 214 formed of ferric oxide on an inner surface of a fixing belt, and thus wearing of the blackened layer 214 of the fixing belt may be reduced.

Figure 8:
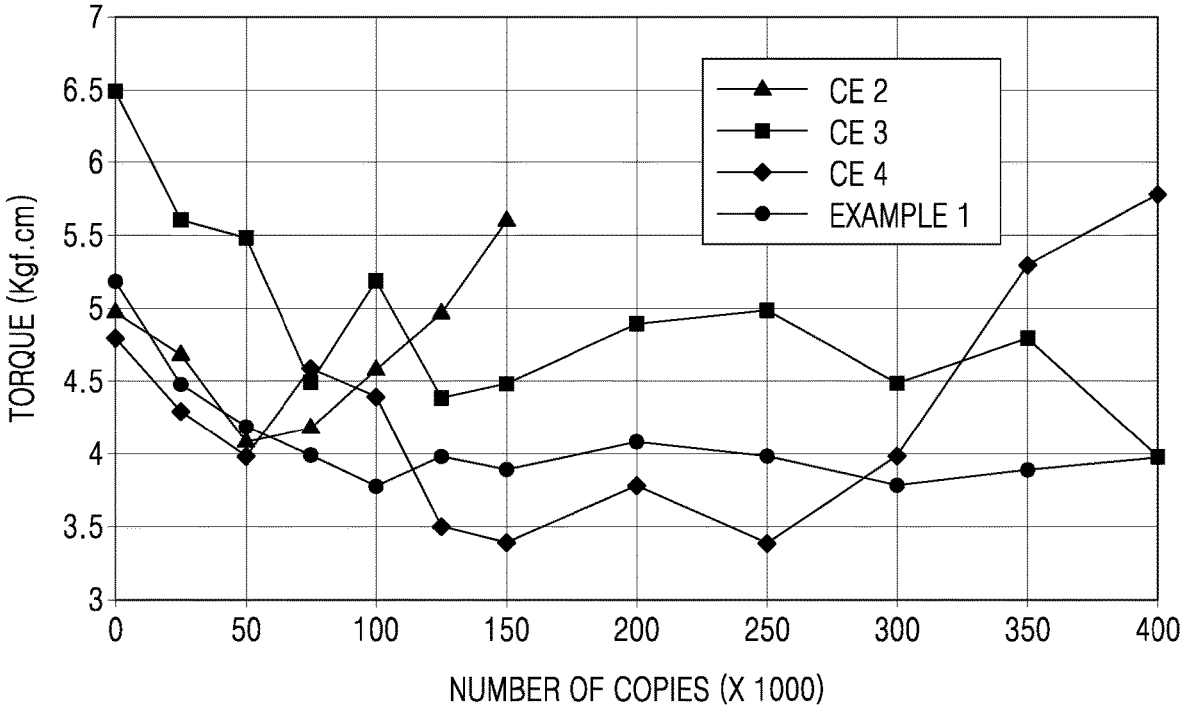
FIG. 8 is a graph showing results of evaluating a change in torque acting on a fixing device in which each of pressing members manufactured according to Comparative Examples 2 to 4 (denoted as CE 2, CE 3 and CE 4, respectively) and Example 1 is installed, in accordance with an increase in the number of copies of the fixing device.

FIG. 8 is a graph showing results of evaluating a change in torque acting on a fixing device in which each of pressing members manufactured according to Comparative Examples 2 to 4 and Example 1 is installed, in accordance with an increase in the number of copies of the fixing device. The fixing device is a fixing device equipped with a commercially available electrophotographic laser printer (Manufacturer: Samsung Electronics, Product Name: M4580). The torque measurement was performed using the following method: When the fixing device starts to be driven, the fixing device rotates while being heated. Torque acting on a motor of each fixing device may be calculated by measuring the amount of current flowing in the motor of each fixing device by using a self-produced measurement jig. The amount of current is measured every 0.5 seconds for about 150 seconds while the fixing device is driven, until it reaches a period in which a change in the amount of current becomes stable. An average of values of the torque acting on the motor of each fixing device in the period in which such a change in the amount of current was stable was measured.

Referring to FIG. 8, it can be seen that in the case of the coating of a blend of PAI and PFA of Comparative Example 2 (CE 2), the torque was rapidly increased when 75,000 or more sheets of paper were printed, and thus the increase in torque was caused by deterioration of grease performance according to wearing of the PAI/PFA coating of the nip plate 220*b* or the blackened layer 214 of the fixing belt 210 in the case of printing of 75,000 or more sheets of paper. It can be seen that in the case of the coating of PPS fiber and PTFE resin of Comparative Example 3 (CE 3), the torque was not much increased, but was unstably changed, and a torque at an initial printing section was very high. It can be seen that in the case of the electron beam-irradiated PFA coating of Comparative Example 4 (CE 4), the torque was rapidly increased when 300,000 or more sheets of paper were printed. This means that the PFA coating on the nip plate 220*b* or the blackened layer 214 formed of ferric oxide on the inner surface of the fixing belt was worn down, resulting in an increase in torque due to deterioration of the performance of grease. In contrast, it can be seen that when the electron beam-irradiated PFA film of Example 1 was used, the fixing device was stably driven without an increase in torque even when the number of copies was increased, and the torque at an initial printing section was also relatively low. From the above results, it can be seen that when the electron beam-irradiated fluorinated resin film attached to the nip plate 220*b* is used, a stable fixing device may be implemented, as compared to other materials. In addition, the occurrence of cracks in the fixing belt due to scratch wear between the nip plate 220*b* and the blacked layer 214 may be efficiently reduced, and thus long lifespan of the fixing device including the fixing belt may be achieved. As such, when the wearing of the blackened layer 214 on the inner surface of the fixing belt is reduced, image defects due to a temperature difference at the surface of the fixing belt 210 may be effectively prevented, and thus a high-performance fixing device with excellent image quality may be obtained.

From the above-described results, it can be seen that a fixing device according to the present disclosure minimizes the wearing of a fixing belt due to friction between a pressing member and the fixing belt, and thus may be efficiently used in high-speed printing and low-energy fixing methods during an extended period of time.

While examples of the present disclosure have been described with reference to the accompanying drawings and examples, these examples are provided for illustrative purposes, and it will be understood by one of ordinary skill in the art to which the present disclosure pertains that various modifications and other examples equivalent thereto may be made. Thus, the scope of the present disclosure should be defined by the appended claims.

What is claimed is:

1. A fixing device comprising:

a fixing belt that is rotatable and has an endless belt shape;

a backup member provided outside the fixing belt to be in contact with the fixing belt, to drive the fixing belt;

a heat source provided inside the fixing belt;

a metal bracket provided below the heat source and to support the heat source; and a pressing member provided between the metal bracket and the fixing belt, to transmit heat from the heat source and pressure through the metal bracket to the fixing belt and to form a fixing nip while facing toward the backup member, wherein the pressing member comprises:

an inner holder to support the metal bracket, a nip plate attached to an outer surface of the inner holder, and an electron beam-irradiated fluorinated resin film formed on an outer surface of the nip plate and toward the backup member, the electron beam-irradiated fluorinated resin film comprising an oxidized surface.

2. The fixing device of claim 1, wherein the electron beam-irradiated fluorinated resin film comprises at least one fluorinated resin selected from the group consisting of a copolymer of tetrafluoroethylene and perfluoroether (PFA), polytetrafluoroethylene (PTFE), and a copolymer of tetrafluoroethylene and hexafluoropropylene (FEP).

3. The fixing device of claim 1, wherein the nip plate comprises a metal selected from stainless steel, nickel, and aluminum.

4. The fixing device of claim 1, wherein a primer layer is provided between the nip plate and the electron beam-irradiated fluorinated resin film, the primer layer to facilitate attaching the electron beam-irradiated fluorinated resin film to the nip plate.

5. The fixing device of claim 1, wherein a water contact angle at the oxidized surface of the electron beam-irradiated fluorinated resin film is less than or equal to a water contact angle at a non-oxidized surface of the electron beam-irradiated fluorinated resin film, the oxidized surface of the electron beam-irradiated fluorinated resin film facing the nip plate.

6. The fixing device of claim 1, wherein the inner holder comprises a first side wall portion, a second side wall portion, and a base portion, wherein the first and second side wall portions are separated from each other, and the base portion connects the first side wall portion to the second side wall portion, a convex portion protrudes from an outer surface of at least one of the first and second side wall portions of the inner holder, and a concave portion is formed at an inner surface of the nip plate, and wherein the nip plate is coupled to the inner holder by insertion of the convex portion into the concave portion.

7. The fixing device of claim 6, wherein the convex portion protrudes from the outer surface of at least one of the first and second side wall portions of the inner holder, an opening passing through the nip plate is formed, and the nip plate is coupled to the inner holder by insertion of the convex portion into the opening.

8. The fixing device of claim 1, wherein the fixing belt comprises a substrate layer and a release layer on an outer surface of the substrate layer.

9. The fixing device of claim 8, wherein the fixing belt further comprises an elastic layer between the substrate layer and the release layer.

10. The fixing device of claim 8, further comprising a metal oxide layer on an inner surface of the substrate layer and in contact with the electron beam-irradiated fluorinated resin film, wherein the metal oxide layer is heatable by the heat source.

11. The fixing device of claim 8, wherein the substrate layer comprises at least one metal selected from stainless steel, nickel, and aluminum.

12. The fixing device of claim 8, wherein the release layer comprises at least one fluorinated resin selected from the group consisting of a copolymer of tetrafluoroethylene and perfluoroether (PFA), polytetrafluoroethylene (PTFE), and a copolymer of tetrafluoroethylene and hexafluoropropylene (FEP).

13. The fixing device of claim 9, wherein the elastic layer comprises at least one elastic resin selected from the group consisting of a fluorine-containing rubber, a silicone rubber, natural rubber, an isoprene rubber, a butadiene rubber, a nitrile rubber, a chloroprene rubber, a butyl rubber, an acrylic rubber, a hydrin rubber, an urethane rubber, a polystyrene-based resin, a polyolefin resin, a polyvinyl chloride-based resin, a polyurethane resin, a polyester resin, a polyamide resin, a polybutadiene-based resin, a trans-polyisoprene-based resin, and a chlorinated polyethylene-based resin.

14. The fixing device of claim 1, wherein the backup member is a backup roller.

15. An imaging apparatus comprising:

a printing unit to form a toner image on a recording medium; and a fixing device to fix the toner image on the recording medium, wherein the fixing device comprises:

a fixing belt that is rotatable and has an endless belt shape;

a backup member provided outside the fixing belt to be in contact with the fixing belt, to drive the fixing belt;

a heat source provided inside the fixing belt;

a metal bracket provided below the heat source and to support the heat source; and a pressing member provided between the metal bracket and the fixing belt, to transmit heat from the heat source and pressure through the metal bracket to the fixing belt and to form a fixing nip while facing toward the backup member, wherein the pressing member comprises:

an inner holder to support the metal bracket, and a nip plate attached to an outer surface of the inner holder, and an electron beam-irradiated fluorinated resin film formed on an outer surface of the nip plate and toward the backup member, the electron-beam irradiated fluorinated resin film comprising an oxidized surface.

16. A fixing device comprising:

a fixing belt that is rotatable and has an endless belt shape;

a backup member provided outside the fixing belt to be in contact with the fixing belt, to drive the fixing belt;

a heat source provided inside the fixing belt;

a metal bracket provided below the heat source and to support the heat source; and a pressing member provided between the metal bracket and the fixing belt, to transmit heat from the heat source and pressure through the metal bracket to the fixing belt and to form a fixing nip while facing toward the backup member, wherein the pressing member comprises:

an inner holder to support the metal bracket, a nip plate attached to an outer surface of the inner holder, an electron beam-irradiated fluorinated resin film formed on an outer surface side of the nip plate and toward the backup member, and a primer layer provided between the nip plate and the electron beam-irradiated fluorinated resin film, the primer layer to facilitate attaching the electron beam-irradiated fluorinated resin film to the nip plate.

* * * * *